US008752716B2

(12) United States Patent
Gibson et al.

(10) Patent No.: US 8,752,716 B2
(45) Date of Patent: Jun. 17, 2014

(54) EXPORT RACK FOR SHEET-LIKE ARTICLES

(75) Inventors: Steven D. Gibson, Spring Hill, KS (US); Dennis Murphy, Olathe, KS (US)

(73) Assignee: AGC Flat Glass North America, Inc., Alpharetta, GA (US)

( * ) Notice: Subject to any disclaimer, the term of this patent is extended or adjusted under 35 U.S.C. 154(b) by 720 days.

(21) Appl. No.: 12/914,490

(22) Filed: Oct. 28, 2010

(65) Prior Publication Data

US 2011/0097186 A1 Apr. 28, 2011

Related U.S. Application Data

(60) Provisional application No. 61/255,717, filed on Oct. 28, 2009.

(51) Int. Cl.
*A47G 19/08* (2006.01)

(52) U.S. Cl.
USPC ..... 211/41.14; 211/175; 211/189

(58) Field of Classification Search
USPC ..... 211/41.1, 41.14–41.16, 175, 182, 189, 211/191, 195, 207, 208; 206/386, 454, 448, 206/600, 451; 108/55.1, 55.5, 52.1
See application file for complete search history.

(56) References Cited

U.S. PATENT DOCUMENTS 3,937,329 A * 2/1976 Hammerel ..... 211/41.14
3,964,608 A * 6/1976 Rowley ..... 206/451
4,832,558 A 5/1989 Tauscheck
4,863,340 A 9/1989 Masunaga et al.
4,881,866 A 11/1989 Harmon
4,899,891 A 2/1990 Sipilä et al.
4,927,032 A 5/1990 Mercure
4,934,538 A 6/1990 Beyer
4,946,031 A 8/1990 Confalonieri
5,145,073 A 9/1992 Kitagawa et al.
5,148,924 A 9/1992 Mason et al.
5,149,353 A 9/1992 Sipila et al.
5,251,766 A 10/1993 Barry
5,284,410 A 2/1994 Sare et al.
5,379,904 A * 1/1995 Brown ..... 211/85.8
5,411,360 A 5/1995 Hilliker et al.
5,520,276 A 5/1996 Aoki et al.
5,562,402 A 10/1996 Muto
5,584,399 A * 12/1996 King ..... 211/41.15
5,603,419 A 2/1997 Peterson
5,636,127 A 6/1997 Aoki et al.
5,641,076 A 6/1997 Englund
5,655,452 A 8/1997 Blake et al.
5,711,429 A 1/1998 Brown
5,769,595 A 6/1998 Pearce et al.
5,791,452 A 8/1998 Reid (Continued)

OTHER PUBLICATIONS

Photographs of Rack, 2 pages.

(Continued)

*Primary Examiner* — Korie H Chan
(74) *Attorney, Agent, or Firm* — Rothwell, Figg, Ernst & Manbeck, P.C.

(57) ABSTRACT

The present invention is directed to an export rack for shipping sheet-like articles. More specifically, the present invention is directed to an export rack that includes at least one support, a removable gate and at least one top restraint. The removable gate includes at least one wedge that is configured to secure sheet-like articles loaded in the export rack.

17 Claims, 16 Drawing Sheets

(56) References Cited

U.S. PATENT DOCUMENTS

| | | | | |
|---|---|---|---|---|
| 5,850,924 | A | 12/1998 | Borter | |
| 5,860,539 | A | 1/1999 | Brown | |
| 5,906,282 | A | 5/1999 | Aldrich et al. | |
| 5,924,577 | A | 7/1999 | Gessert | |
| 6,102,206 | A * | 8/2000 | Pride | 206/454 |
| 6,164,461 | A | 12/2000 | Ward et al. | |
| 6,216,893 | B1 | 4/2001 | Lee | |
| 6,234,324 | B1 | 5/2001 | Getz | |
| 6,247,601 | B1 | 6/2001 | Norton et al. | |
| 6,247,887 | B1 | 6/2001 | Springston et al. | |
| 6,286,668 | B1 | 9/2001 | Moses | |
| 6,308,969 | B1 | 10/2001 | Young | |
| 6,386,376 | B1 | 5/2002 | Mendoza-Castillo et al. | |
| 6,427,851 | B1 | 8/2002 | Chang | |
| 6,431,372 | B1 | 8/2002 | Aoyama | |
| 6,454,106 | B1 | 9/2002 | Howard | |
| 6,591,962 | B2 | 7/2003 | Miyake | |
| 6,591,988 | B2 | 7/2003 | Trpkovski | |
| 6,669,030 | B2 | 12/2003 | Tsao et al. | |
| 6,742,663 | B2 * | 6/2004 | Chubb | 211/41.14 |
| 6,783,010 | B1 | 8/2004 | Berger | |
| 6,948,623 | B2 | 9/2005 | Takano | |
| 6,969,035 | B2 | 11/2005 | Leopold et al. | |
| 7,080,864 | B2 | 7/2006 | Casteran | |
| 7,210,579 | B2 | 5/2007 | Fujioka et | |
| 7,217,077 | B2 | 5/2007 | Mercure | |
| 7,322,923 | B2 | 1/2008 | Harris et al. | |
| 7,357,261 | B2 | 4/2008 | Yamamoto et al. | |
| 7,434,858 | B1 | 10/2008 | Lastinger et al. | |
| 2005/0205500 | A1 * | 9/2005 | Yamamoto et al. | 211/41.14 |
| 2007/0221592 | A1 * | 9/2007 | Strauss et al. | 211/41.15 |

OTHER PUBLICATIONS

Countermeasures of packing for A-MAT, Jun. 10, 2009, 11 pages.

* cited by examiner

EXPORT RACK FOR SHEET-LIKE ARTICLES

CROSS-REFERENCE TO RELATED APPLICATION

This application claims the benefit of U.S. Provisional Application No. 61/255,717, filed Oct. 28, 2009, which is hereby incorporated by reference in its entirety into the present application.

BACKGROUND OF THE INVENTION

1. Field of the Invention

The present invention relates to an export rack that may be used for the transportation and storage of sheet-like articles, such as glass lites. More particularly, the present invention relates to an export rack that is designed to facilitate loading and unloading of sheet-like articles and that includes a pressing member for improving the security of sheet-like articles to the export rack.

2. Discussion of the Background

All United States Patents and Patent Applications referred to herein are hereby incorporated by reference in their entireties. In the case of conflict, the present specification, including definitions, will control.

In the sheet-like article hauling industry, there are many different types of sheet-like article racks and methods for their transportation. For example, lites of glass may be loaded onto a rack or similar device and shipped, for example, on a flat bed trailer or a freight train. These types of racks generally include a base portion for placement of the glass lites and a back portion to support the glass lites in an upright manner.

There are certain types of racks that comprise only a base portion and a back portion. These types of racks offer the advantage of easy loading and unloading of glass lites. However, the glass lites in these racks must be secured using bands or other securing means. These securing means can be difficult to put on and usually must be cut when the glass lites are unloaded. Thus, the securing means may only be used once. Furthermore, the cutting of such securing means for unloading sheet-like articles may pose a danger to workers, such as laceration.

There are also certain types of racks that include a pressing device in addition to a base portion and back portion. Pressing devices perform a similar function to the aforementioned bands or securing means, but offer the advantage of being used more than once. However, most pressing devices are generally built into, or affixed to, the rack, which may make it more difficult to load and unload glass lites. For example, U.S. Pat. No. 7,357,261 discloses a packing device for plate like articles that includes a pressing member built into the rack. The plate-like articles, such as glass lites, must be slid in or out of the rack during packing and unloading. Further, the pressing device requires the user to manipulate locking members to cause the pressing member to engage the plate-like articles, which may result in the pressing member not properly engaging the plate-like articles due to human error. Further, U.S. Pat. No. 5,711,429 discloses a packing device for sheet-like articles with pressing members. This device must be packed and unloaded on its back and then lifted upright due to the design of the walls and pressing members.

Thus, there remains a need in the art for a sheet-like article rack that offers a reusable securing mechanism for securing sheet-like articles, such as glass lites, to a rack, while at the same time providing for efficiency and ease with loading and unloading of such sheet-like articles.

SUMMARY OF THE INVENTION

The present invention is made to solve the above-identified problems, and aims to provide a sheet-like article rack that allows for easy loading and unloading of sheet-like articles, such as glass lites, while having a pressing device for securing such sheet-like articles to the rack that is capable of repeated use.

The present invention provides improvements in the loading, unloading, securing, transportation and storage of sheet-like articles, such as glass lites.

In an aspect of the present invention, there is provided an apparatus for transporting and storing sheet-like articles. The apparatus includes a base portion, at least one back portion post extending upwardly from the base portion and oriented to support said sheet-like articles and at least one brace extending vertically from said base portion. The at least one brace is oriented to support each of the at least one back portion post. The apparatus further includes a gate and at least one front wedge. The gate is movable between a transportation position and a loading position. The front wedge is coupled to the gate. The front wedge includes at least one arm and a sheet engaging member movable relative to the at least one arm. The sheet engaging member is configured to engage the sheet-like articles by moving relative to the at least one arm of the front wedge until the sheet engaging member is in contact with the sheet-like articles.

In another aspect of the invention, there is provided a transportation position of the gate that comprises coupling the gate to the base portion.

In another aspect of the invention, there is provided a loading position of the gate that comprises removing the gate from the base portion.

In another aspect of the invention, there is provided an apparatus that further includes at least one cleat extending from the base portion at an angle from horizontal and configured to support the sheet-like articles. In an aspect of the present invention, a right angle is formed between the at least one cleat and the at least one back portion post. In an aspect of the present invention, the at least one cleat extends from the base portion at a five degree angle from horizontal and the at least one back portion post extends from the base portion at an angle of ninety-five degrees from horizontal.

In another aspect of the invention, there is provided at least one back portion post that is parallel to the at least one front wedge.

In another aspect of the invention, there is provided a base portion that further includes openings configured to accept the arms of a lifting device on each of the vertical faces of the base portion.

In another aspect of the invention, there is provided an apparatus that further includes a top restraint that is configured to couple the top of the gate and the top of the brace.

In another aspect of the invention, there is provided at least one arm of the front wedge that is arranged such that the arms closer to the base portion are shorter than the arms farther from the base portion. In an aspect of the present invention, there is provided a front wedge that includes three arms.

In another aspect of the invention, there is provided a sheet engaging member that is slidable relative to the at least one arm.

In another aspect of the invention, there is provided a sheet engaging member that includes notches at the end of the sheet engaging member. In an aspect of the present invention, there is provided an apparatus that further comprises a securing mechanism for coupling the sheet engaging member to the base portion. In an aspect of the present invention, the Securing mechanism is an elastic, and is capable of repeated use.

DETAILED DESCRIPTION OF THE INVENTION

While the present invention may be embodied in many different forms, a number of illustrative embodiments are described herein with the understanding that the present disclosure is to be considered as providing examples of the principles of the invention and such examples are not intended to limit the invention to preferred embodiments described and/or illustrated herein. The various embodiments are disclosed with sufficient detail to enable those skilled in the art to practice the invention. It is to be understood that other embodiments may be employed, and that structural and logical changes may be made without departing from the spirit and scope of the present invention.

Figure 1:
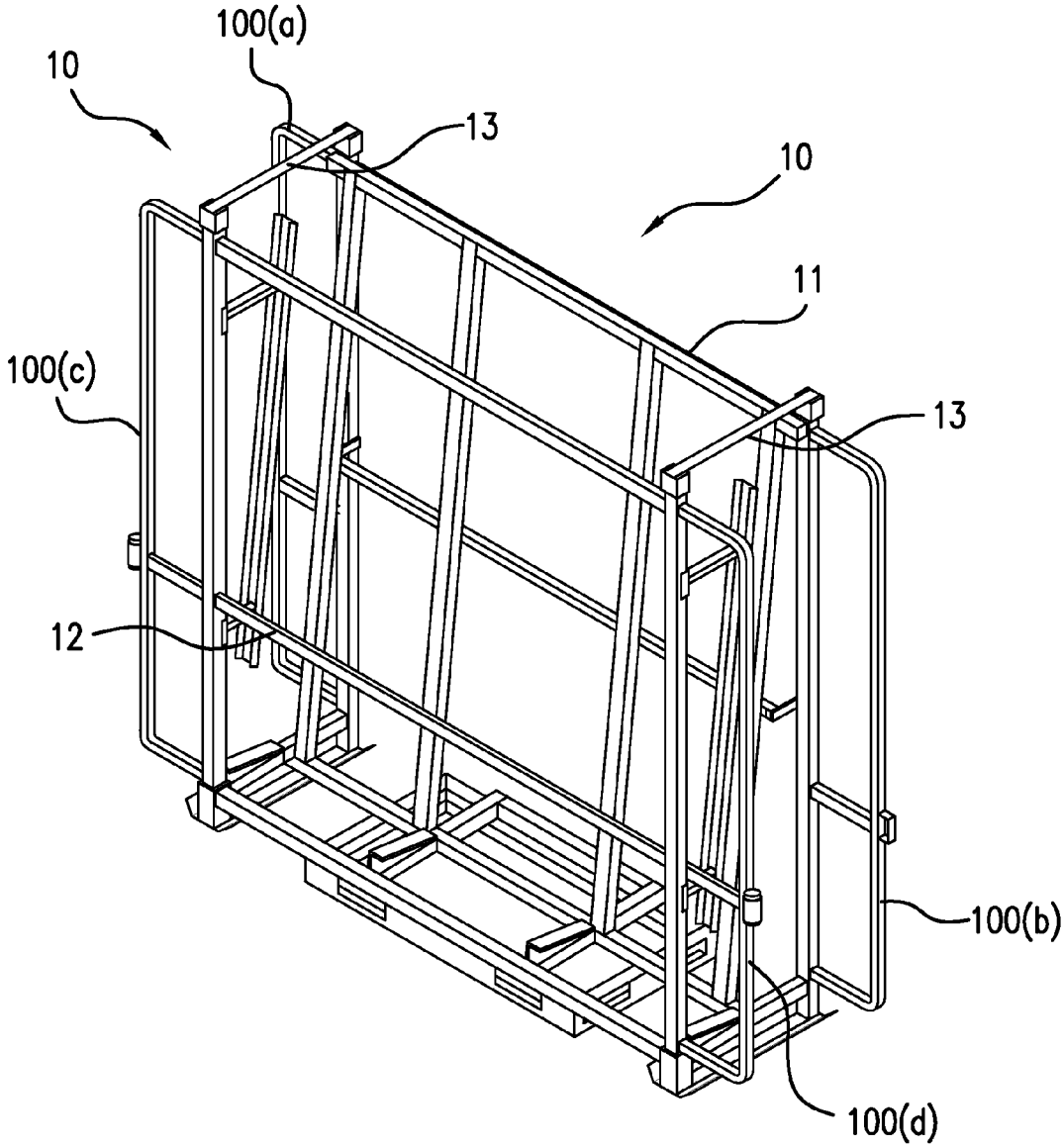
FIG. 1 is a perspective view of an assembled export rack according to an embodiment of the present invention.

FIG. 1 is a perspective view of an assembled export rack 10 according to an embodiment of the present invention. The export rack 10 includes a support 11, a gate 12 and a top restraint 13. The gate 12 is coupled to the support 11. The gate 12 is in a transportation position when it is coupled to the support 11. The top restraint 13 couples the gate 12 to the support 11 when the gate 12 is in a transportation position.

Figure 2:
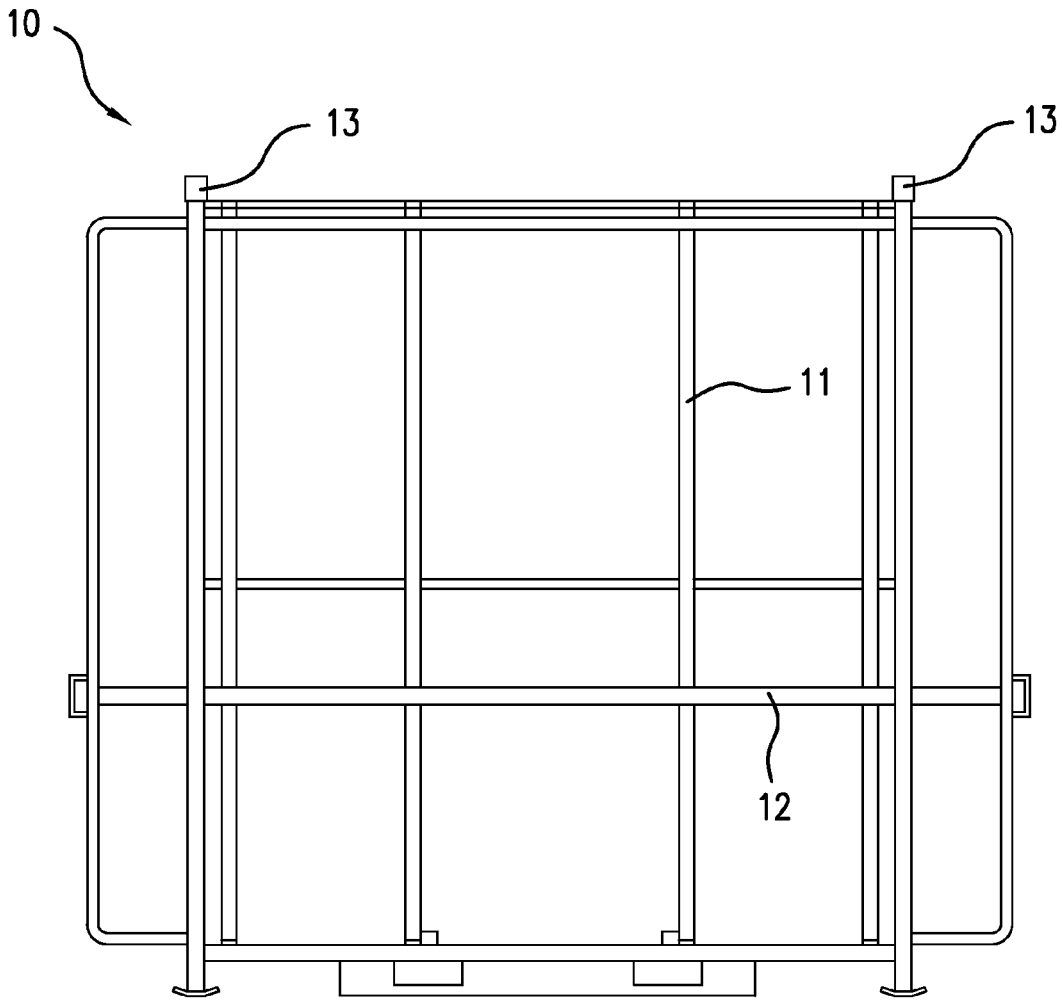
FIG. 2 is a front view of an assembled export rack according to an embodiment of the present invention.

FIG. 2 is a front view of the assembled export rack 10 shown in FIG. 1 according to an embodiment of the present invention.

Figure 3:
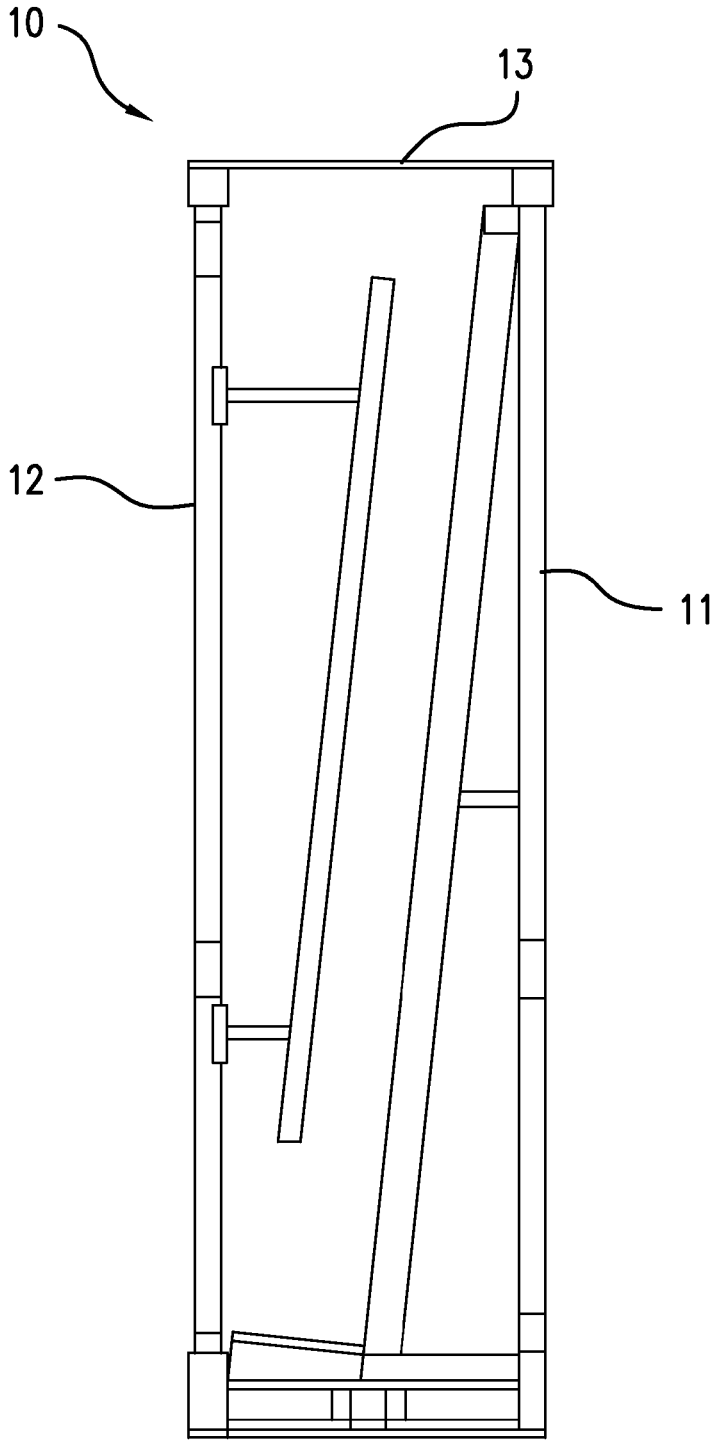
FIG. 3 is a side view of an assembled export rack according to an embodiment of the present invention.

FIG. 3 is a side view of the assembled export rack 10 shown in FIG. 1 according to an embodiment of the present invention.

Figure 4:
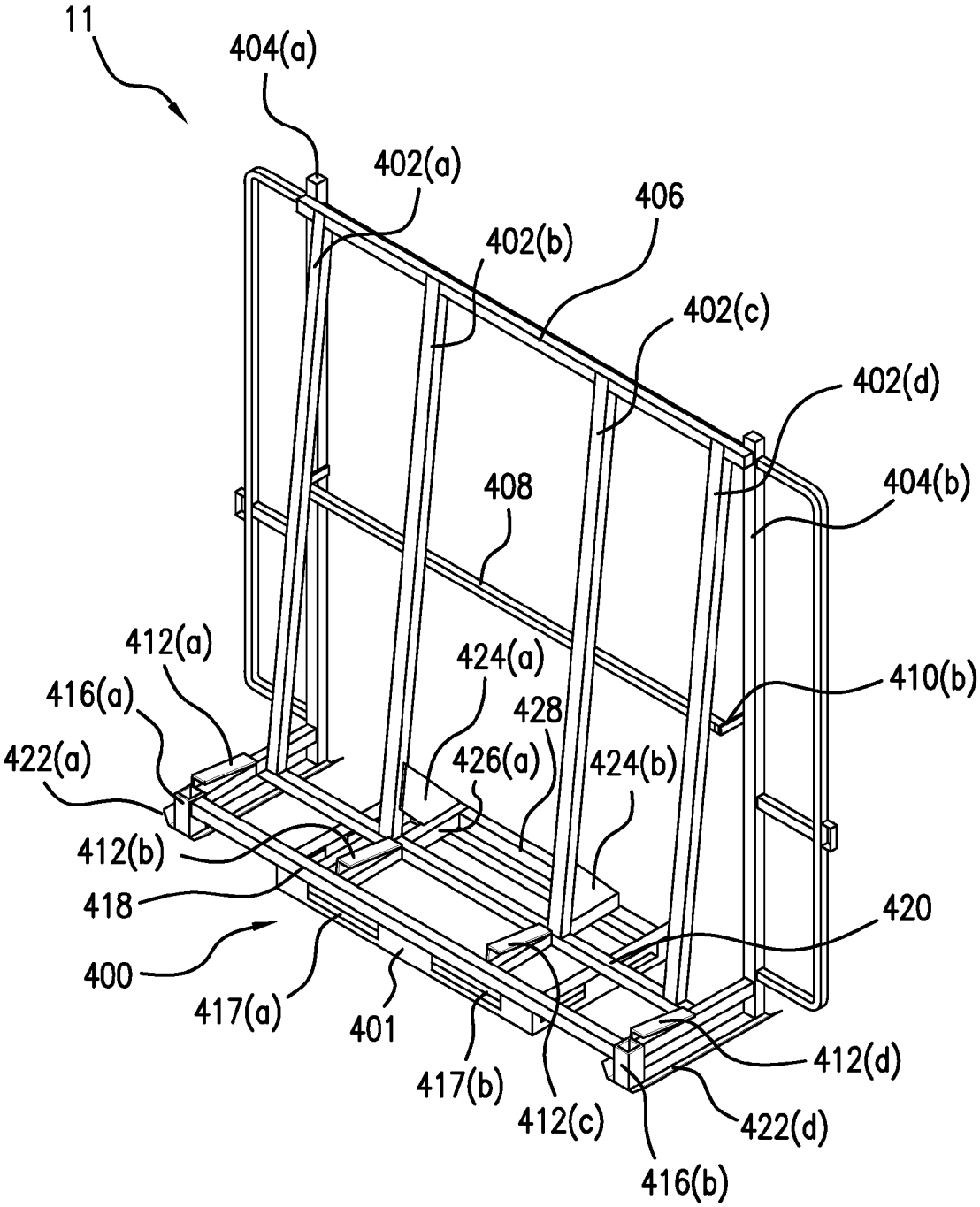
FIG. 4 is a perspective view of a support according to an embodiment of the present invention.

FIG. 4 is a perspective view of a support 11 according to an embodiment of the present invention. The support 11 includes a base portion 400, back posts 402(*a*)-(*d*), braces 404(*a*) and (*b*), a top cross support 406, a middle cross support 408, middle cross support coupling arms 410(*a*) and (*b*), cleats 412(*a*)-(*d*), cleat base portions 414(*a*)-(*d*) (see FIG. 8) and receiving holes 416(*a*) and (*b*). The base portion 400 includes a support block 401. The support block 401 is a rectangular block. In an embodiment of the present invention, the support block 401 is between forty inches and fifty-six inches wide, twenty to thirty-two inches deep and two to six inches high. In a preferred embodiment of the present invention, the support block 401 is forty-five to fifty inches wide, twenty-three to twenty-nine inches deep and three to five inches high. The support block may be made of steel, such as A36 steel, or any other suitable material known in the art.

The back posts 402(*a*)-(*d*) extend upwardly from the base portion 400. The back posts 402(*a*)-(*d*) are oriented to support sheet-like articles loaded on the support 11. In an embodiment of the present invention, the back posts 402(*a*)-(*d*) extend upwardly from the base portion at an angle from vertical. In an embodiment of the present invention, the back posts 402(*a*)-(*d*) extend upwardly from the base portion 400 at 95 degrees from horizontal. In FIG. 4, there are four back posts 402(*a*)-(*d*), however there may be more or less back posts (e.g. three or six) according to the present invention. The back posts 402(*a*)-(*d*) may be rectangular tubes made of steel, such as ASTM A500, or any other suitable material known in the art. The back posts 402(*a*)-(*d*) are oriented such that a flat surface of the back post faces the front of the support 11. In an embodiment of the present invention, the back posts 402(*a*)-(*d*) may be rectangular tubes with sides between one and three inches. In a preferred embodiment of the present invention, the back posts 402(*a*)-(*d*) maybe rectangular tubes with sides between one and one-half and two and one-half inches. In an embodiment of the present invention, the back posts 402(*a*)-(*d*) are between seventy-five and ninety-five inches long. In a preferred embodiment of the present invention, the back posts are between eighty-two and eighty-eight inches long.

The braces 404(*a*) and (*b*) extend upwardly from the base portion 400. The braces 404(*a*) and (*b*) are configured to support the back posts 402(*a*)-(*d*). In an embodiment of the present invention, the braces 404(*a*) and (*b*) extend vertically from the base portion 400. In FIG. 4, there are two braces 404(*a*) and (*b*), however there may more or less braces (e.g., one or four) according to the present invention. According to an embodiment of the present invention, the two outermost braces 404(*a*) and (*b*) are outside the outermost back posts 402(*a*) and (*d*). In an embodiment of the present invention, the outermost braces 404(*a*) and (*b*) are each between one-quarter and one and one-half inches outside the outermost back posts 402(*a*) and (*d*). In a preferred embodiment of the present invention, the outermost braces 404(*a*) and (*b*) are each between one-half and one inch outside the outermost back posts 402(*a*) and (*d*). The braces 404(*a*) and (*b*) may be rectangular tubes made of steel, such as ASTM A500, or any other suitable material known in the art. In an embodiment of the present invention, the braces 404(*a*) and (*b*) may be rectangular tubes with sides between one and three inches. In a preferred embodiment of the present invention, the braces

404(*a*) and (*b*) maybe rectangular tubes with sides between one and one-half and two and one-half inches.

A top cross support 406 is coupled to the top of each back post 402(*a*)-(*d*). The top cross support 406 is further coupled to the braces 404(*a*) and (*b*). The top cross support 406 may be a rectangular tube made of steel, such as ASTM A500, or any other suitable material known in the art. In an embodiment of the present invention, the top support 406 may be a rectangular tube with sides between one and three inches. In a preferred embodiment of the present invention, the top support 406 maybe rectangular tubes with sides between one and one-half and two and one-half inches. In an embodiment of the present invention, the top support is between sixty-six and eighty-two inches long. In a preferred embodiment of the present invention, the top support is between seventy-one and seventy-seven inches long. The middle cross support 408 is coupled to each back post 402(*a*)-(*d*). The middle cross support 408 is further coupled to middle cross support coupling arms 410(*a*) and (*b*). Each middle cross support coupling arm 410(*a*) and (*b*) is coupled to an end of the cross middle support 408 and further coupled to a brace 404(*a*) and (*b*). The middle cross support 408 can be a rectangular tube made of steel, such as ASTM A500, or any other suitable material known in the art. In an embodiment of the present invention, the cross middle support 408 may be rectangular tubes with sides between one-half and three inches. In a preferred embodiment of the present invention, the cross middle support 408 maybe rectangular tubes with sides between one and two and one-half inches. In an embodiment of the present invention, the cross middle support 408 is between sixty-three and seventy-seven inches long. In a preferred embodiment of the present invention, the cross middle support 408 is between sixty-seven and seventy-three inches long. The middle cross support coupling arms 410(*a*) and (*b*) can be a rectangular bar made of steel, such as hot rolled steel, or any other suitable material known in the art. In an embodiment of the present invention, the middle cross support coupling arms 410(*a*) and (*b*) may be one-rectangular bars between one-quarter and one-half inch high, one-half to two inches wide and three to seven inches long. In a preferred embodiment of the present invention, the middle cross support coupling arms 410(*a*) and (*b*) may be one-rectangular bars one-quarter inch high, one-half to one inch wide and four to six inches long. The top cross support 406, the middle cross support 408 and the middle cross support coupling arms 410(*a*) and (*b*) transfer weight from the back posts 402(*a*)-(*d*) to the braces 404(*a*) and (*b*).

According to an embodiment of the present invention, all coupling is done via welding unless otherwise noted or depicted in the figures (e.g., the gate 12 being coupled to the support 11 via being inserted into the support 11).

Cleats 412(*a*)-(*d*) extend from the cleat base portions 414(*a*)-(*d*) at an angle from horizontal. See FIG. 8 for a detailed view of the cleats according to an embodiment of the present invention. The cleat base portions 414(*a*)-(*d*) extend horizontally from the front-to-back of the base portion 400. According to an embodiment of the present invention, cleat base portions 414(*a*) and (*d*) are coupled to the receiving holes 416(*a*) and (*b*) and the braces 404(*a*) and (*b*) and cleat base portions 414(*b*) and (*c*) are coupled to the support block 401. According to an embodiment of the present invention, the cleat base portions 414(*a*)-(*d*) may be different lengths. In an embodiment of the present invention, the cleat base portions 414(*a*)-(*d*) may be a rectangular tube with sides between one and three inches. In a preferred embodiment of the present invention, the cleat base portions 414(*a*)-(*d*) maybe rectangular tubes with sides between one and one-half and two and one-half inches. In an embodiment of the present invention, cleat base portions 414(*a*) and (*d*) are between sixteen and twenty-six inches long. In a preferred embodiment of the present invention, cleat base portions 414(*a*) and (*d*) are between nineteen and twenty-three inches long. In an embodiment of the present invention, cleat base portions 414(*b*) and (*c*) are between eight and sixteen inches long. In a preferred embodiment of the present invention, cleat base portions 414(*b*) and (*c*) are between ten and fourteen inches long. The cleat base portions 414(*a*)-(*d*) may be rectangular tubes made of steel, such as ASTM A500, or any other suitable material known in the art. The cleats 412(*a*)-(*d*) and the back posts 402(*a*)-(*d*) form a right angle. In an embodiment of the present invention, the cleats 412(*a*)-(*d*) extend from the base portion at five degrees from horizontal and the back posts 402(*a*)-(*d*) extend from the base portion a ninety-five degrees from horizontal. The cleats 412(*a*)-(*d*) may be L-shaped arms. In an embodiment of the present invention, the cleats 412(*a*)-(*d*) are L-shaped arms comprising two bars between one and three inches wide, one-tenth and one-quarter inch thick and nine and fourteen inches long. The cleats 412(*a*)-(*d*) may be made of iron or any other suitable material known in the art. The cleats 412(*a*)-(*d*) are oriented such that a flat surface supports the sheet-like articles.

Receiving holes 416(*a*) and (*b*) are positioned in the base portion 400 in front of the cleats 412(*a*)-(*d*) and are open on the end facing up and closed on the bottom. In an embodiment of the present invention, the receiving holes 416(*a*) and (*b*) are positioned in the front edge of the base portion 400 at the outermost edges of the base portion 400. The receiving holes 416(*a*) and (*b*) can be rectangular tubes made of steel, such as ASTM A500, or any other suitable material known in the art. In an embodiment of the present invention, the receiving holes 416(*a*) and (*b*) are rectangular tubes with sides between one and four inches long and a height between four and seven inches.

In an embodiment of the present invention, the base portion 400 further includes openings 417(*a*)-(*d*) on the vertical faces of the support block 401, a front base portion bar 418, a back post base portion bar 420 and base portion protrusions 422(*a*) and (*b*). Openings 417(*a*)-(*d*) are in the vertical faces of the support block 401. The openings 417(*a*)-(*d*) are configured to accept the forks of pallet jack or fork lift. Openings 417(*a*) and (*b*) extend from the front-to-back of the support block 401. Openings 417(*c*) and (*d*) extend from the right-to-left sides of the support block 401. Thus, a pallet jack or fork lift may engage the support 11 from any side.

The front base portion bar 418 extends across the support block 401 at the front of the support 11. The front base portion bar 418 is coupled to the top of the support block 401. In an embodiment of the present invention, the front base portion bar 418 is coupled to the receiving holes 416(*a*) and (*b*). The front base portion bar 418 can be a rectangular tube made of steel, such as ASTM A500, or any other suitable material known in the art. In an embodiment of the present invention, the front base portion bar 418 is rectangular bar with sides between one and three inches wide. In an embodiment of the present invention, the base portion bar 418 is between sixty-four and seventy-six inches long. In a preferred embodiment of the present invention, the base potion bar 418 is between sixty-eight and seventy-two inches long. The back post base portion bar 420 extends across the top of the support block 401 and perpendicular to the back posts 402(*a*)-(*d*). The back post base portion bar 420 is coupled to the support block 401 and further coupled to each of the back posts 402(*a*)-(*d*). The back post base portion bar 420 provides stability to the back posts 402(*a*)-(*d*). The back post base portion bar 420 can be a rectangular tube made of steel, such as ASTM A500, or any other suitable material known in the art. In an embodiment of the present invention, the back post base portion bar 420 is a rectangular tube with sides between one and three inches wide. In an embodiment of the present invention, the back post base portion bar 420 is between sixty-four and seventy-six inches long. In a preferred embodiment of the present invention, the back post base portion bar 420 is between sixty-eight and seventy-two inches long. Base portion protrusions 422(*a*)-(*d*) are coupled to the bottom of the receiving holes 416(*a*) and (*b*) and the braces 404(*a*) and (*b*). The base portion protrusions 422 extend the length of the base portion 400 from front-to-back. In an embodiment of the present invention, the base portion protrusions 422(*a*)-(*d*) may form a triangle with the receiving holes 416(*a*) and (*b*) and the braces 404(*a*) and (*b*). In another embodiment of the present invention, the bottom of base portion protrusion 422(*a*) is coupled to the bottom of base protusion 422(*b*) by a bar. Further, the bottom of base portion protrusion 422(*c*) is coupled to the bottom of base protusion 422(*d*) by a bar. According to an embodiment of the present invention, the protrusions 422(*a*)-(*d*) extend between one-half and two and one-half inches off the ground. The protrusions 422(*a*)-(*d*) are configured to couple to the locking mechanisms of an export rack indexing table. Export rack indexing tables can be used to handle export racks at loading and unloading stations. The base portion protrusions may be made of steel, such as ASTM A500, or any other suitable material known in the art.

In another embodiment of the present invention, the support 11 further includes lower braces 424(*a*) and (*b*), brace supports 426(*a*) and (*b*) and brace support bar 428. The lower braces 424(*a*) and (*b*) each couple a back post 402 to a brace support 426. The brace supports 426(*a*) and (*b*) are each coupled to the support block 401. The brace support bar 428 couples the brace supports 426(*a*) and (*b*) to each other. The lower braces 424(*a*) and (*b*) provide further support for the back post 402 and transfer weight from the back posts 402 to the support block 401. In an embodiment of the present invention, there are two lower braces 424(*a*) and (*b*) coupled to the middle back posts 402(*b*) and (*c*). In another embodiment of the present invention, there may be more or less than two lower brace 424(*a*) and (*b*) and they may be placed on back posts 402 not in the middle of the support 11. In an embodiment of the present invention, the lower braces 424(*a*) and (*b*) may be triangles with sides between six and twelves inches long. In a preferred embodiment of the present invention, the lower braces 424(*a*) and (*b*) are right triangles with sides between eight and ten inches long. In another embodiment of the present invention, the braces 424(*a*) and (*b*) may be a quadrilateral or any other shape capable of coupling the middle back posts 402(*b*) and (*c*) to the brace supports 426(*a*) and (*b*). The lower braces 424 may be made of steel, such as ASTM A500, or any other suitable material known in the art, and have a width of eight gauges. In an embodiment of the present invention, the brace supports 426(*a*) and (*b*) may be rectangular tubes with sides between one and three inches wide with a thickness between ten and eighteen gauges. In an embodiment of the present invention, the brace supports 426 (*a*) and (*b*) are between six and twelve inches long. In a preferred embodiment of the present invention, the brace supports 426(*a*) and (*b*) are between eight and ten inches long. The brace supports 426 may be made of steel, such as ASTM A500, or any other suitable material known in the art. The brace support bar 428 couples the brace supports 426(*a*) and (*b*) to each other. In an embodiment of the present invention, the brace support bar 428 may be a rectangular tube with sides between one-half and three inches wide and ten and eighteen gauges thick. In an embodiment of the present invention, the brace support bar 428 is between twenty and thirty-two inches long. In a preferred embodiment of the present invention, the brace support bar 428 is between twenty-four and twenty-eight inches long.

Figure 5:
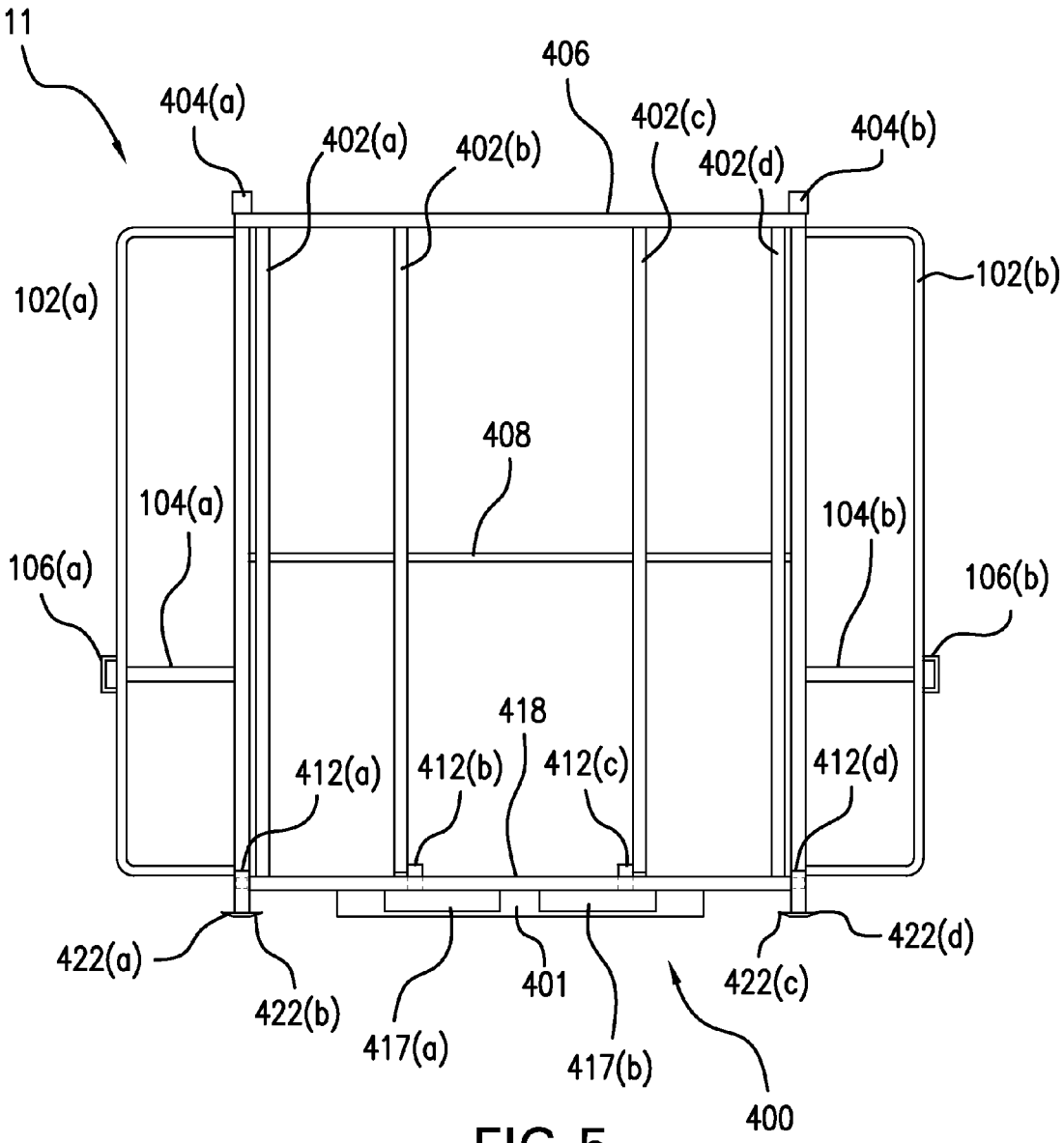
FIG. 5 is a back view of a support according to an embodiment of the present invention.

FIG. 5 is a back view of the support 11 shown in FIG. 4 according to an embodiment of the present invention.

Figure 6:
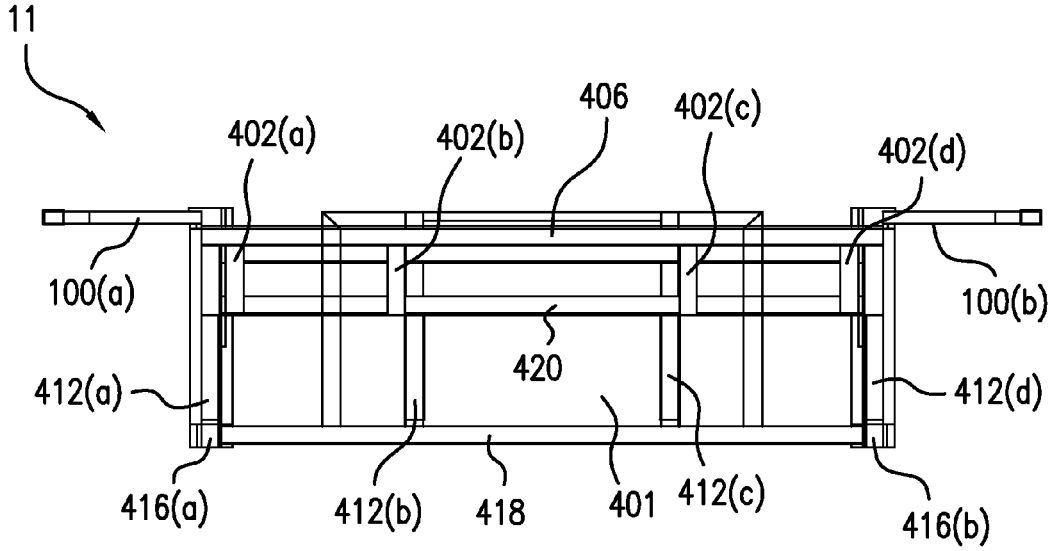
FIG. 6 is a top view of a support according to an embodiment of the present invention.

FIG. 6 is a top view of the support 11 shown in FIG. 4 according to an embodiment of the present invention.

Figure 7:
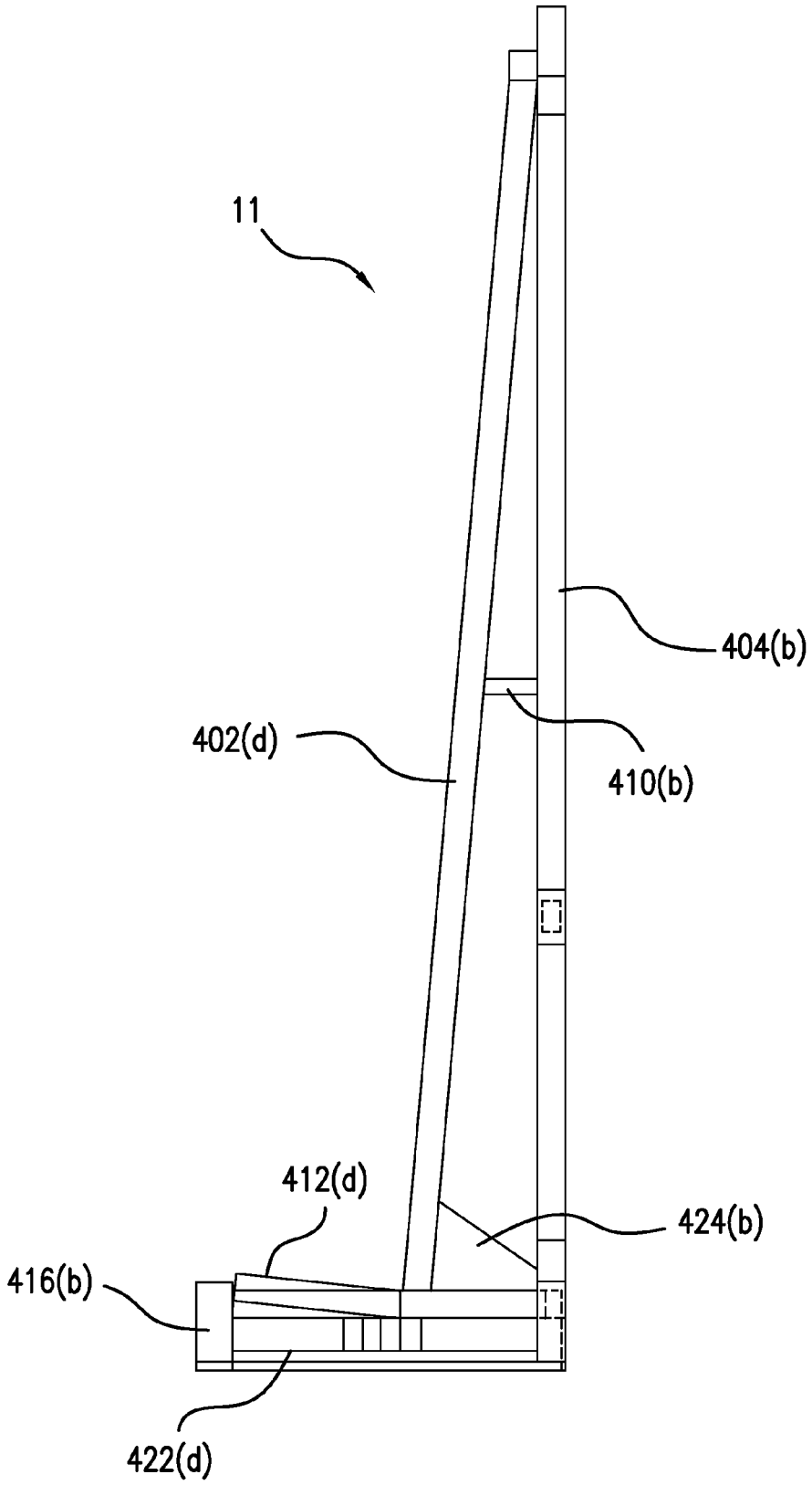
FIG. 7 is a side view of a support according to an embodiment of the present invention.

FIG. 7 is a side view of the support 11 shown in FIG. 4 according to an embodiment of the present invention.

Figure 8:
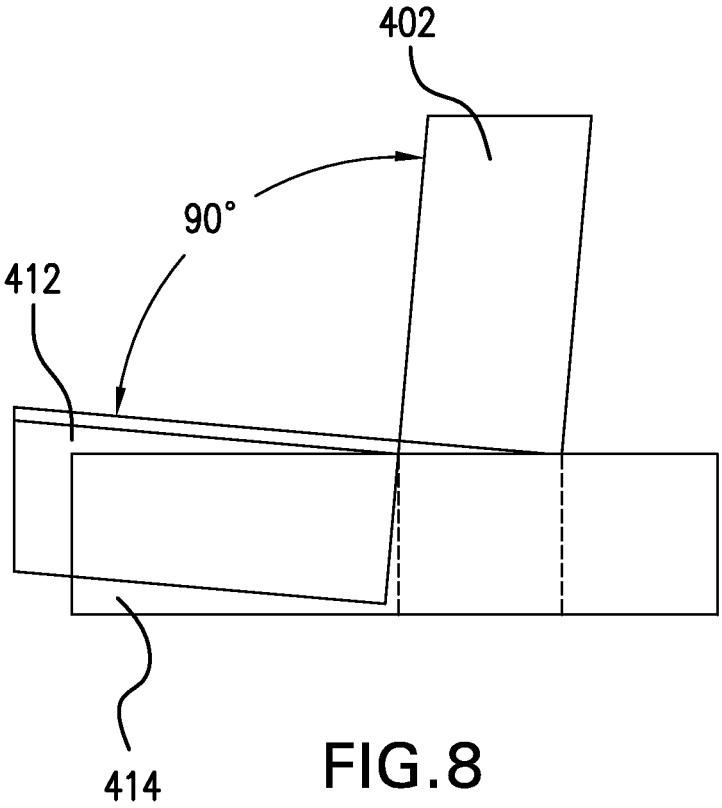
FIG. 8 is a detailed view of cleats according to an embodiment of the present invention.

FIG. 8 is a detailed view of cleats 412 according to an embodiment of the present invention. As can be better appreciated from FIG. 8, the cleats 412(*a*)-(*d*) extend from the cleat bases 414(*a*)-(*d*) at an angle from horizontal. According to an embodiment of the present invention, the cleats 412(*a*)-(*d*) are configured to create approximately a right angle with the back posts 402(*a*)-(*d*).

Figure 9:
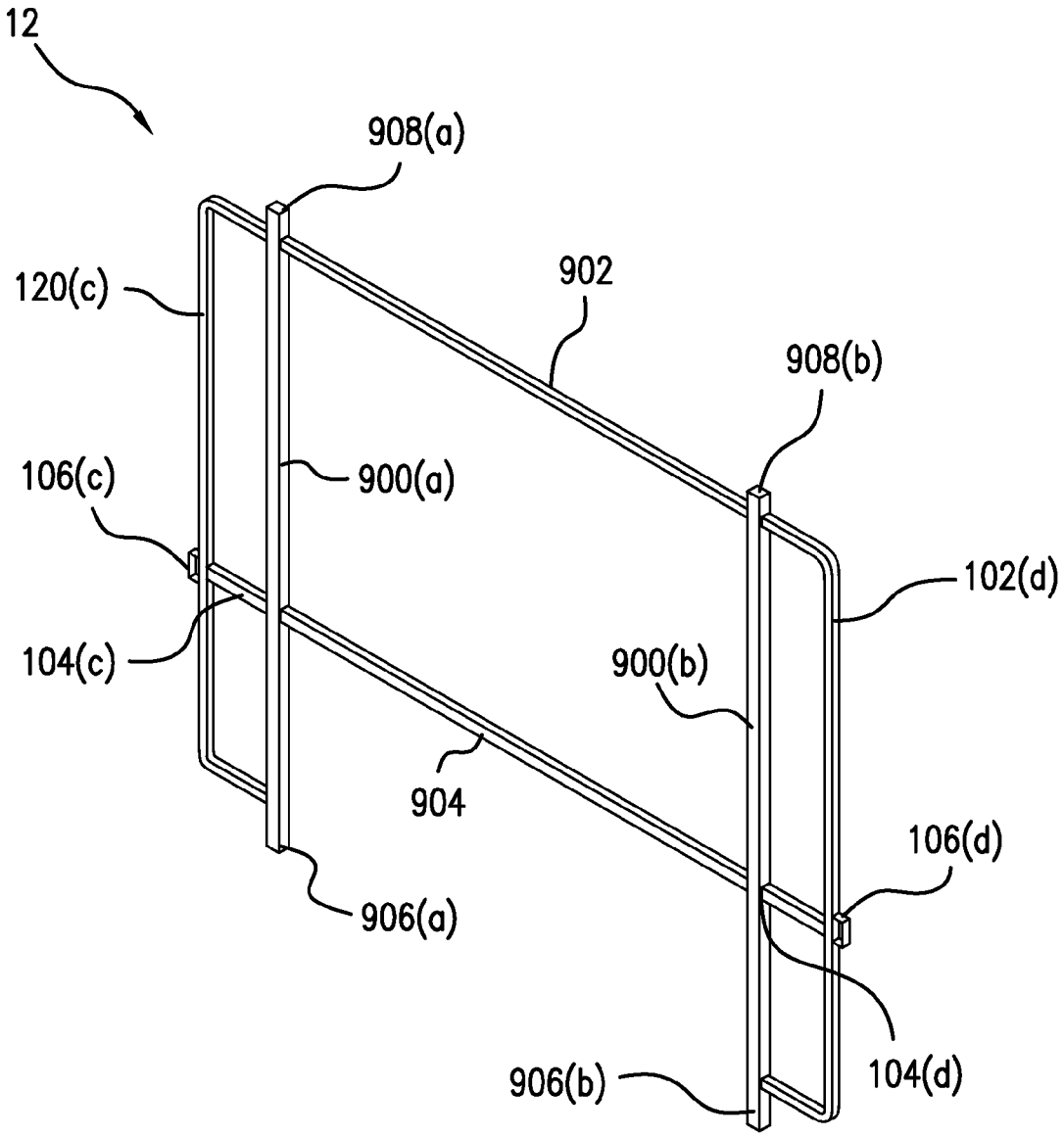
FIG. 9 is a perspective view of a gate according to an embodiment of the present invention.

FIG. 9 is a perspective view of a gate 12 according to an embodiment of the present invention. The gate 12 includes vertical bars 900(*a*) and (*b*), an upper horizontal bar 902, a lower horizontal bar 904, bottom protrusions 906(*a*) and (*b*) and top protrusions 908(*a*) and (*b*). The vertical bars 900(*a*) and (*b*) can be rectangular tubes made of steel, such as ASTM A500, or other suitable materials known in the art. In an embodiment of the present invention, the vertical bars 900(*a*) and (*b*) can be rectangular tubes with sides between one and three inches wide. In an embodiment of the present invention, the vertical bars 900(*a*) and (*b*) are between eighty-eight and one hundred and two inches long. In a preferred embodiment of the present invention, the vertical bars are between ninty-two and ninety-seven inches long. In FIG. 9, there are two vertical bars 900(*a*) and (*b*), however there may be more vertical bars (e.g. three or four). In an embodiment of the present invention, the exterior surfaces of the two vertical bars 900(*a*) and (*b*) are between seventy and eighty inches away from each other. In a preferred embodiment of the present invention, the exterior surfaces of the two vertical bars 900(*a*) and (*b*) are between seventy-two and seventy-seven inches away from each other.

An upper horizontal bar 902 extends between the vertical bars 900(*a*) and (*b*). The upper horizontal bar 902 is coupled to the interior of each vertical bar 900(*a*) and (*b*). In an embodiment of the present invention, the upper horizontal bar 902 is between eight-two and ninety-four inches from the bottom of vertical bars 900(*a*) and (*b*). In a preferred embodiment of the present invention, the upper horizontal bar 902 is between eight-six and ninety inches from the bottom of vertical bars 900(*a*) and (*b*). The lower horizontal bar 904 extends between the vertical bars 900(*a*) and (*b*). The lower horizontal bar 904 is coupled to the interior of each vertical bar 900(*a*) and (*b*). According to an embodiment of the present invention, the lower horizontal bar 904 is between thirty and forty inches from the bottom of vertical bars 900(*a*) and (*b*). In a preferred embodiment of the present invention, the upper horizontal bar 902 is between thirty-three and thirty-seven inches from the bottom of vertical bars 900(*a*) and (*b*). The upper horizontal bar 902 and the lower horizontal bar 904 are rectangular tubes made of steel, such as ASTM A500, or any other suitable material known in the art. In an embodiment of the present invention, the upper horizontal bar 902 and the lower horizontal bar 904 are rectangular tubes with sides between one-half and four inches wide. In another embodiment of the present invention, there may be additional horizontal bars extending between the vertical bars 900(*a*) and (*b*).

Figure 10:
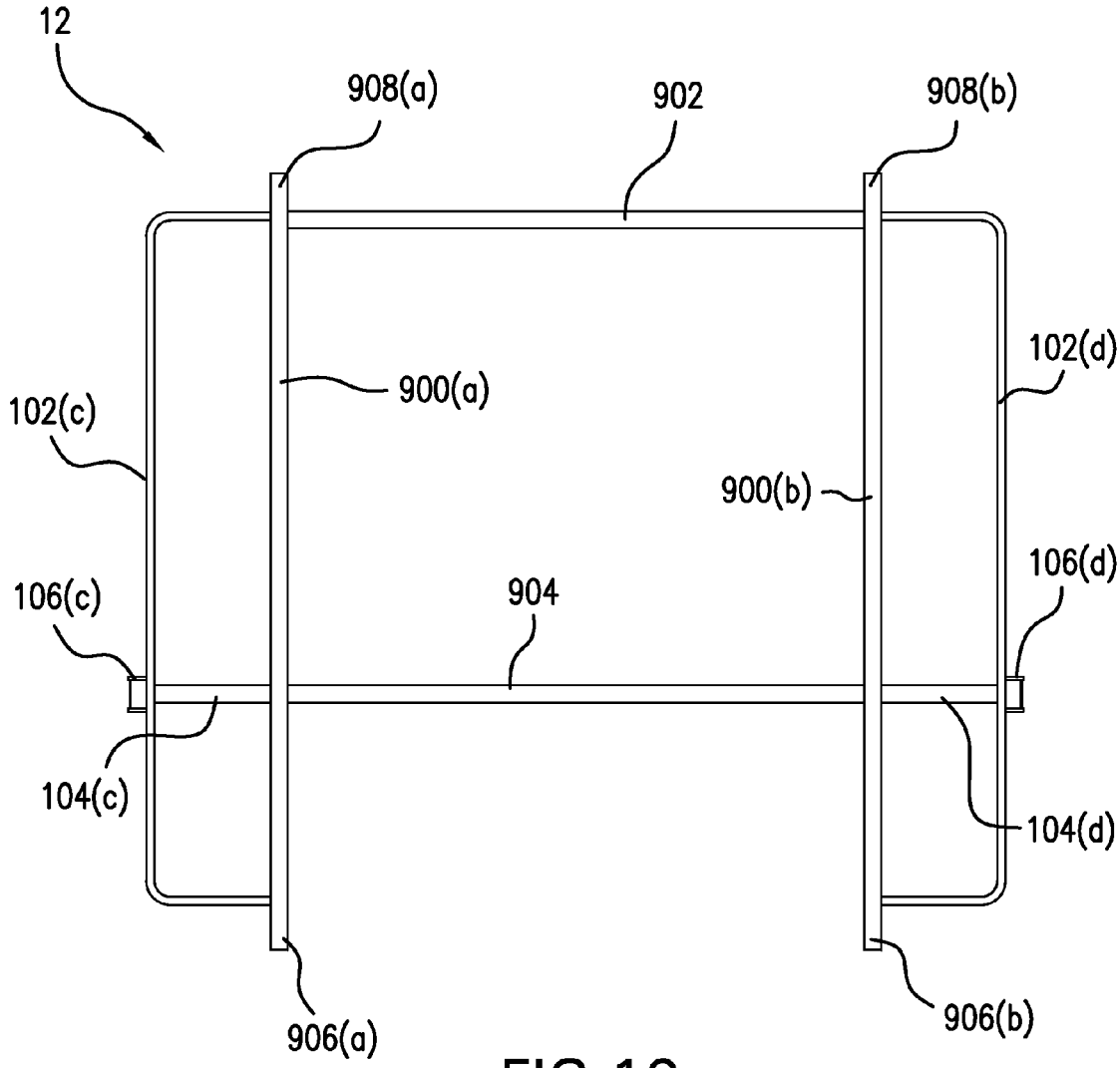
FIG. 10 is a front view of a gate according to an embodiment of the present invention.
Figure 11:
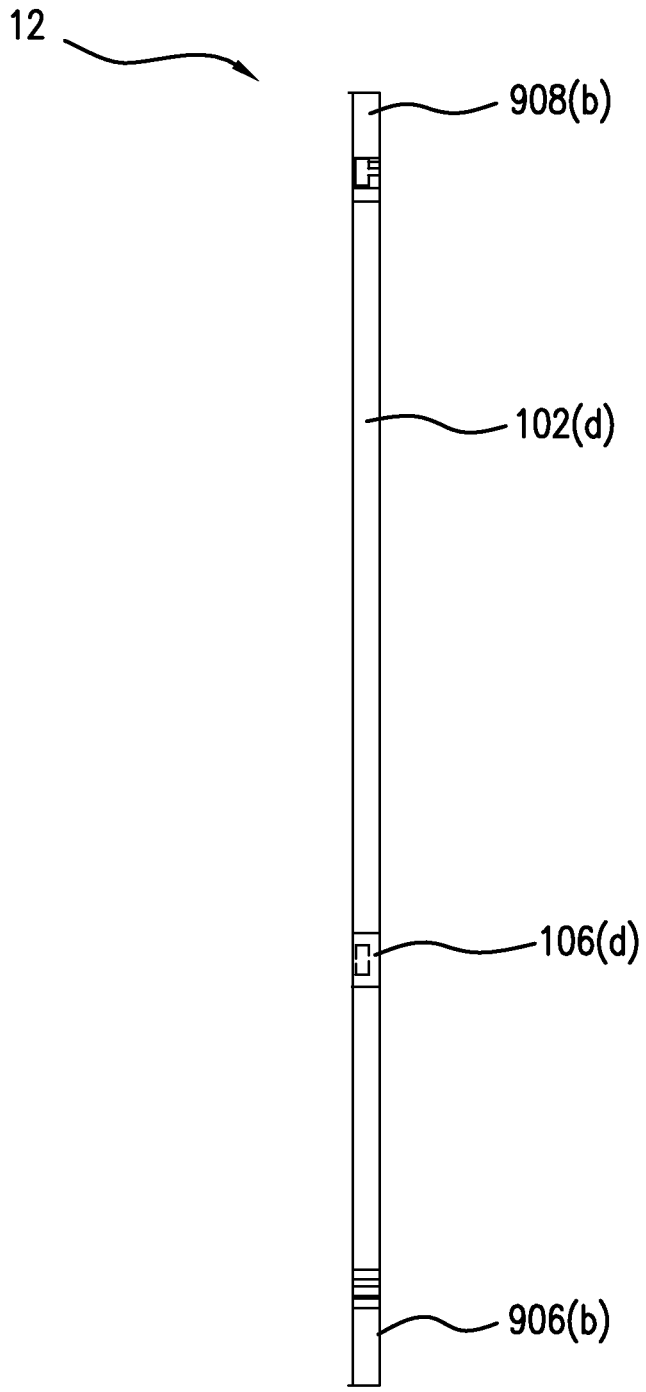
FIG. 11 is a side view of a gate according to an embodiment of the present invention.

The bottom protrusions 906(*a*) and (*b*) are the lower portions of the vertical bars 900(*a*) and (*b*) in FIGS. 9-11. In another embodiment of the present invention, the bottom protrusions 906(*a*) and (*b*) have a different shape (e.g., circular or triangular) or dimensions than the vertical bars 900(*a*) and (*b*). The bottom protrusions 906(*a*) and (*b*) couple the gate 12 to the support 11. The upper protrusions 908(*a*) and (*b*) are the upper portion of the vertical bars 900(*a*) and (*b*) in FIGS. 9-11. In another embodiment of the present invention, the upper protrusions 908(*a*) and (*b*) have a different shape (e.g., circular or triangular) or dimensions than the vertical bars 900(*a*) and (*b*). The bottom protrusions 908(*a*) and (*b*) couple the gate 12 to the top restraint 13. If desired, hooks or latches (not shown) may be incorporated onto the upper protrusions 908(*a* and *b*) such that the gate 12 portion of an assembled export rack 10 of the present invention can be lifted by a crane, hoist or other lifting mechanism. When lifting an assembled export rack 10 of the present invention using hooks or latches, a locking mechanism (not shown) that secures the gate 12 to the receiving holes 416(*a* and *b*) of the base portion 400 is employed.

FIG. 10 is a front view of the gate 12 shown in FIG. 9 according to an embodiment of the present invention.

FIG. 11 is a side view of the gate 12 shown in FIG. 9 according to an embodiment of the present invention.

Figure 12:
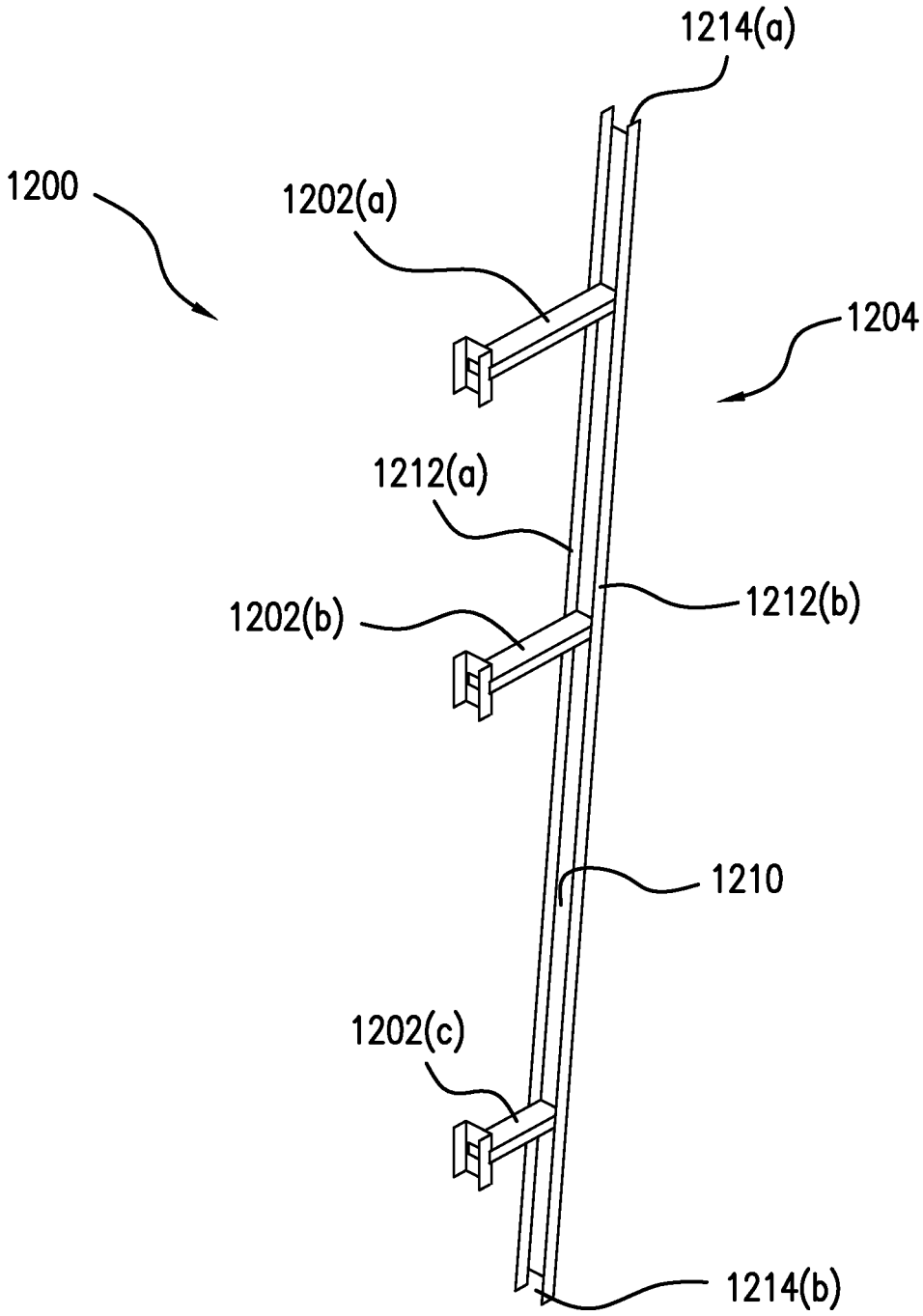
FIG. 12 is a perspective view of a front wedge according to an embodiment of the present invention.

The gate 12 further includes a front wedge 1200 according to an embodiment of the present invention. See FIG. 1. FIG. 12 is a front wedge 1200 according to an embodiment of the present invention. The front wedge 1200 includes arms 1202 (*a*)-(*c*) and a sheet engaging member 1204. The arms 1202 (*a*)-(*c*) include brackets 1206(*a*)-(*c*) and bars 1208(*a*)-(*c*). The brackets 1206(*a*)-(*c*) are coupled to the vertical bars 900(*a*) and (*b*) of the gate 12. The brackets 1206(*a*)-(*c*) include three bars in a U-shape. The brackets 1206(*a*)-(*c*) are oriented such that the parallel bars of the "U" extend over the sides of a vertical bar 900(*a*) or (*b*) and the middle portion of the "U" is pressed against the back surface of a vertical bar 900(*a*) or (*b*). In another embodiment of the present invention, the brackets 1206(*a*)-(*c*) may be any design capable of coupling the arms 1202(*a*)-(*c*) to the vertical bars 900(*a*) and (*b*), such as an L-shape. In an embodiment of the present invention, the brackets 1206(*a*) and (*b*) are welded to the vertical bars 900(*a*) and (*b*). The bars 1208(*a*)-(*c*) are coupled to the brackets 1206 and extend from the brackets 1206(*a*)-(*c*) in a direction perpendicular to the vertical bars 900(*a*) and (*b*). The bars 1208(*a*)-(*c*) are further coupled to the sheet engaging member 1204 in a manner that will be described in greater detail below. The bars 1208(*a*)-(*c*) are rectangular tubes made of steel, such as ASTM A500, or any other suitable material known in the art. In an embodiment of the present invention, the bars 1208(*a*)-(*c*) are rectangular bars between one-half and two and one-half inches high and one and three inches wide. The length of each bar 1208(*a*)-(*c*) will vary in order to orient the sheet engaging member 1204 at a desired angle. In an embodiment of the present invention the bars 1208(*a*)-(*c*) are arranged such that the bars 1208(*a*)-(*c*) farther from the base portion 100 are longer than the bars 1208(*a*)-(*c*) closer to the base portion 100. In an embodiment of the present invention, the lowest bar 1208(*a*) is between five and nine long, the middle bar 1208(*b*) is between eight and twelve inches long and the upper bar 1208(*c*) is between ten and fourteen inches long.

The sheet engaging member 1204 includes a pressing bar 1210, side bars 1212(*a*) and (*b*) and notches 1214(*a*) and (*b*). The pressing bar 1210 is configured to engage sheet-like articles loaded on the support 1. The side bars 1212(*a*) and (*b*) are coupled to the pressing bar 1210 to form a U-shape. An edge of each side bar 1212(*a*) or (*b*) is coupled to the edges of the pressing bar 1210 such that the side bars 1212(*a*) and (*b*) form right angles with the pressing bar 1210. The pressing bar 1210 and the side bars 1212(*a*) and (*b*) form a C-channel that the front wedge arms 1202(*a*)-(*c*) are slidably connected to. The C-channel allows for sheet engaging member 1204 to move relative to the arms 1202(*a*)-(*c*). The notches 1214(*a*) and (*b*) are located at the end of the sheet engaging member 1204. The notches 1214(*a*) and (*b*) are formed by the side bars 1212(*a*) and (*b*) extending beyond the pressing bar 1210. The sheet engaging member 1204 may be made of steel, such as hot rolled steel, or any other suitable material known in the art. In an embodiment of the present invention, the steel has a thickness between ten and eighteen gauges. In an embodiment of the present invention, the sheet engaging member 1204 is between eighty-five and ninety-seven inches long. In a preferred embodiment of the present invention, the sheet engaging member 1204 is between eighty-eight and ninety-three inches long. In an alternative embodiment of the present invention, the sheet engaging member is between twenty four and fourty eight inches long.

In an embodiment of the present invention, there are two front wedges 1200. In another embodiment of the present invention, there may be more or less than two front wedges 1200. The additional front wedges 1200 may be coupled to another vertical bar 900 or it may be coupled to the upper horizontal bar 902 and the lower horizontal bar 904, wherein the front wedge 1200 would have only two arms 1202.

In another embodiment of the present invention, the side bars 1212(*a*) and (*b*) include protrusions on the surface facing inward. The protrusions would help to keep the sheet engaging member 1204 in place when there are vibrations or bumps during transportation. The protrusions would be small enough that the sheet engaging member 1204 could slide relative to the arms, but still provide enough resistance that that arm would not move out of place.

Figure 13:
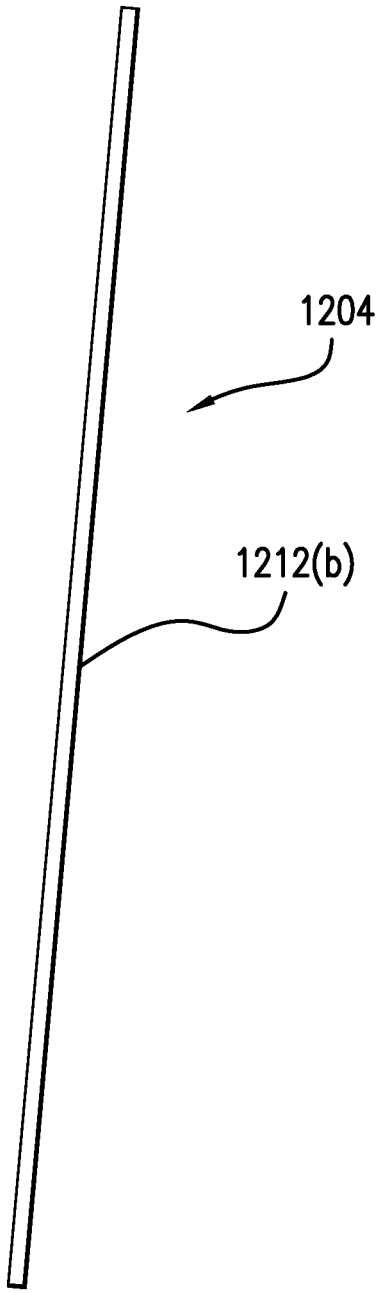
FIG. 13 is a side view of a sheet engaging member according to an embodiment of the present invention.

FIG. 13 is a side view of the sheet engaging member 1204 shown in FIG. 12 according to an embodiment of the present invention.

Figure 14:
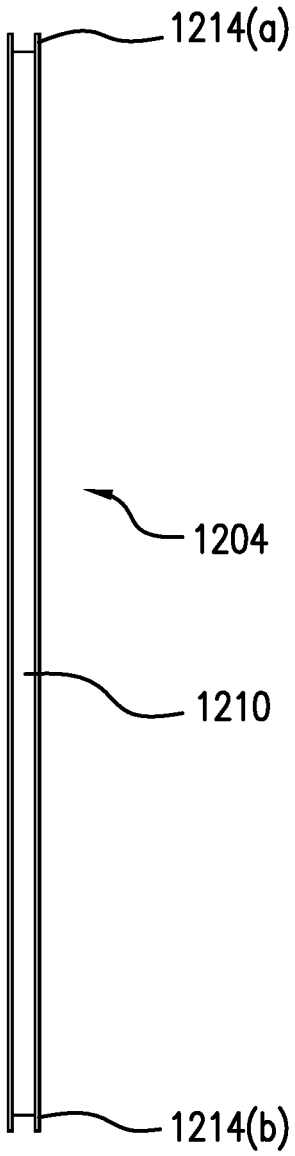
FIG. 14 is a front view of a sheet engaging member according to an embodiment of the present invention.

FIG. 14 is a front view of the sheet engaging member 1204 shown in FIG. 12 according to an embodiment of the present invention.

Figure 15:
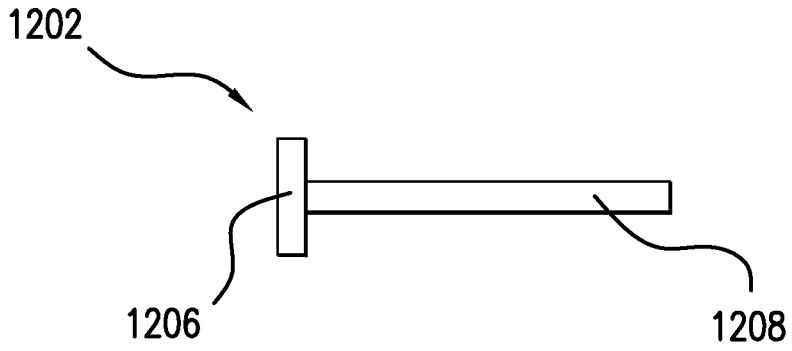
FIG. 15 is a side view of an arm according to an embodiment of the present invention.

FIG. 15 is a side view of the arm 1202 shown in FIG. 12 according to an embodiment of the present invention.

Figure 16:
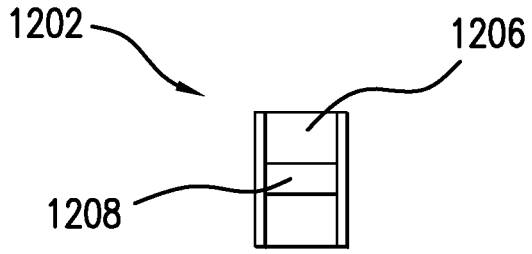
FIG. 16 is a front view of an arm according to an embodiment of the present invention.

FIG. 16 is a front view of the arm 1202 shown in FIG. 12 according to an embodiment of the present invention.

Figure 17:
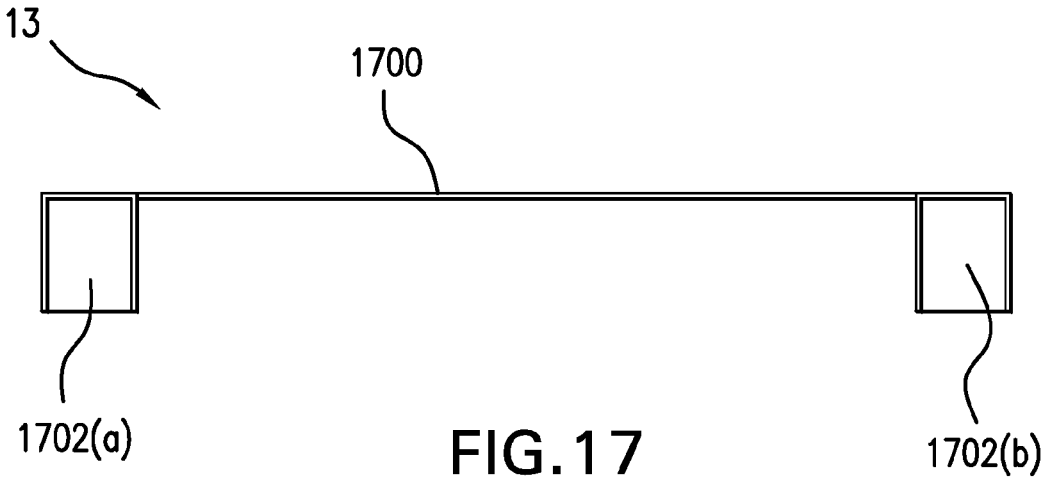
FIG. 17 is a front view of a top restraint according to an embodiment of the present invention.

FIG. 17 shows a top restraint 13 according to an embodiment of the present invention. The top restraint 13 includes a bar 1700 and two receiving holes 1702(*a*) and (*b*). The bar 1700 extends across the top of the top restraint 13. The bar 1700 may be made of steel, such as hot rolled steel, or any other suitable material known in the art. In an embodiment of the present invention, the bar 1700 is between one-eighth and one inch high and one-half and two and one-half inches wide. In an embodiment of the present invention, the bar 1700 is between twenty and thirty inches long. In a preferred embodiment of the present invention, the bar is between twenty-four and twenty-eight inches long. The receiving holes 1702(*a*) and (*b*) are coupled to the ends of the bar 1700 such that the bar 1700 covers one end of the receiving holes 1702(*a*) and (*b*). Receiving hole 1702(*a*) is configured to couple to a brace 402 of the support 11 and receiving hole 1702(*b*) is configured to couple to a vertical bar 900 of the gate 12. In an embodiment of the present invention, the receiving holes are rectangular tubes between one and four inches wide on each side and between one and five inches long. In an embodiment of the present invention, there are two top restraints 13, one to couple to each brace 404 and vertical bar top protrusion 908.

In another embodiment of the present invention, there may be as many top restraints 13 as there are vertical bar top protrusions 908 and braces 404.

Figure 18:
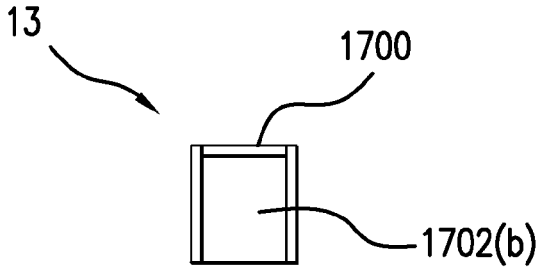
FIG. 18 is a side view of a top restraint according to an embodiment of the present invention.

FIG. 18 is a side view of the top restraint 13 shown in FIG. 17 according to an embodiment of the present invention.

As can be seen in FIGS. 1-3, the gate 12 and the support 11 both include wings 100(*a*)-(*d*). The wings 100(*a*)-(*d*) include a frame 102, a horizontal bar 104 and receiving slots 106. The wings 100(*a*)-(*d*) allow for the export rack to transport oversized lites of glass. The support wings 100(*a*) and (*b*) are parallel to the gate wings 100(*c*) and (*d*). The frames 102(*a*)-(*d*) extend outwardly from the support 11 and gate 12. The wings 102(*a*)-(*d*) are oriented such that the receiving slots 106(*a*)-(*d*) are aligned. In an embodiment of the present invention, a bar, such as a wooden two-by-four, is placed in the receiving slots 106 to secure the sheet-like articles loaded in the assembled export rack 10. The wings 100 may be made of steel, such as ASTM A500, or other suitable materials known in the art. In an embodiment of the present invention, the assembled rack 10 measures between one hundred and one hundred and fifteen inches across the wings. In a preferred embodiment of the present invention, the assembled rack 10 measures between one hundred and four and one hundred and ten inches across the wings.

In operation, sheet-like articles are loaded on to the support 11. The sheet-like articles are placed on the cleats 412 and rest against the back posts 402. After the sheet-like articles are loaded on to the support 11, the gate 12 is coupled to the support 11. The bottom protrusions 906 of the gate are inserted into the receiving holes 416 of the support 11 to couple the gate 12 to the support 11. When the gate 12 is coupled to the support 11, the front wedges 1200 engage the sheet-like articles via the sheet engaging members 1204 sliding into contact with the sheet-like articles. The pressing bars 1210 engage the top sheet-like article. The pressing bars 1210 will be parallel to the face of the sheet-like article because the sheet-like articles are supported by the back posts 402 and the cleats 412 and the back posts 402 and the pressing bars 1210 are configured to be parallel to each other and form a right angle with the cleats 412. After the gate 12 has been coupled to the support 11, top restraints 13 are coupled to the gate 12 and the support 11. The top restraints 13 are coupled to the gate 12 and support 11 by inserting the upper protrusions 908 and the braces 404 into the receiving slots 1702.

In another embodiment of the present invention, after the top restraints 13 have been coupled to the gate 12 and the support 11 a two-by-four is inserted into the receiving slots 106 on both sides of the rack 10. The two-by-fours further secure the sheet-like articles in the assembled export rack 10.

In another embodiment of the present invention, the sheet engaging member 1204 may be held in place by a securing means, such as an elastic. The securing means may be placed such that a downward force is exerted on the sheet engaging member 1204. In another embodiment of the present invention, the securing means may be placed on the upper notch 1214(*a*) of the sheet engaging member 1204 and one of the front wedge arms 1202.

In operation, a user loads the sheet-like articles on to the support 11. The user can place the sheet-like articles on the cleats 412 by mechanical means, such as a robotic arm with suction cups capable of supporting a sheet-like article. The sheet-like articles are placed on the cleats such that they rest against the back posts 402. After the sheet-like articles are loaded on to the support 11, the user can couple the gate 12 to the support 11. The user may manually handle the gate 12 to insert the bottom protrusions 906 of the gate into the receiving holes 416 of the support 11. When the gate 12 is coupled to the support 11, the front wedges 1200 engage the sheet-like articles via the sheet engaging members 1204 sliding into contact with the sheet-like articles. The pressing bars 1210 engage the top sheet-like article. The pressing bars 1210 will be parallel to the face of the sheet-like article because the sheet-like articles are supported by the back posts 402 and the cleats 412, and the back posts 402 and the pressing bars 1210 are configured to be parallel to each other and form a right angle with the cleats 412. In an embodiment of the present invention, the user can further secure the sheet engaging members in place by coupling the sheeting engaging members to the base portion with a securing mechanism, such as an elastic. After the gate 12 has been coupled to the support 11, a user couples top restraints 13 to the gate 12 and the support 11. The top restraints 13 are coupled to the gate 12 and support 11 by inserting the upper protrusions 908 and the braces 404 into the receiving slots 1702.

In another embodiment of the present invention, after the top restraints 13 have been coupled to the gate 12 and the support 11, the user can insert a two-by-four into the receiving slots 106 on both sides of the rack 10. The two-by-fours further secure the sheet-like articles in the assembled export rack 10.

Articles that may be transported by the export rack of the present invention include, but are not limited to, glass lites. Glass lites may be between eighty to ninety inches wide and ninety-five to one hundred and five inches high with a thickness between one-tenth and one-quarter inch. Other material may be shipped in the export racks, such as plastic substrates.

The assembled export rack 10 may be transported by a pallet jack or fork lift. The forks of the pallet jack or fork lift may engage the support block openings 417. The pallet jack or fork lift may transport the fork lift to a flat bed truck, boat, plane or any other transportation means.

The sheet-like articles are unloaded from the export rack 10 by first removing the top restraints 13. The top restraints 13 may be removed by lifting the top restraints 13 upwardly from the upper protrusions 908 and braces 404. The gate 12 may then be removed by lifting the bottom protrusions 906 out of the receiving holes 416. The sheet-like articles are now exposed and maybe unloaded.

The above-described loading, transporting and unloading operations are advantageous over previous loading systems and methods. In the present invention, the user is not exposed to risk from cutting material used to bind the sheet-like articles to the rack. Further, the loading and unloading operations are simplified so that the user only has to couple or remove the top restraints and the gate. This reduces the chance for human error. Furthermore, the present invention is reusable.

While the present invention has been described with respect to specific embodiments, it is not confined to the specific details set forth, but includes various changes and modifications that may suggest themselves to those skilled in the art, all falling within the scope of the invention as defined by the following claims.

What is claimed is:

1. An apparatus for transporting at least one sheet-like article, comprising:

a base portion;

at least one back post extending upwardly from the base portion and oriented to support said at least one sheet-like article;

at least one brace extending vertically from said base portion;

wherein said at least one brace is oriented to support said at least one back post;

a front gate movable between a transportation position and a loading position;

at least one front wedge coupled to said front gate;

wherein each front wedge includes at least one arm and a sheet engaging member;

wherein the at least one arm comprises a bracket and a bar;

wherein the bar has a first end and a second end;

wherein the first end of the bar is coupled to the bracket and the second end of the bar is slidably connected to the sheet engaging member; and wherein said sheet engaging member is configured to engage said at least one sheet-like article by moving relative to said at least one arm of the front wedge until the sheet engaging member is in contact with the at least one sheet-like article.

2. The apparatus of claim 1, wherein said transportation position comprises said front gate being coupled to said base portion.

3. The apparatus of claim 1, wherein said loading position comprises said front gate being removed from said base portion.

4. The apparatus of claim 1, further comprising at least one cleat extending from said base portion at an angle from horizontal and configured to support said at least one sheet-like article;

wherein the at least one cleat is coupled to the apparatus.

5. The apparatus of claim 4, wherein a right angle is formed between said at least one cleat and said at least one back post.

6. The apparatus of claim 5, wherein said at least one cleat extends from said base portion at a five degree angle from horizontal and said at least one back post extends from said base portion at a ninety-five degree angle from horizontal.

7. The apparatus of claim 1, wherein said at least one back post and said at least one front wedge sheet engaging member are parallel when said front gate is in a transportation position.

8. The apparatus of claim 1, wherein said base portion further includes openings configured to accept the arms of a lifting device on each of the vertical faces of the base portion.

9. The apparatus of claim 1, further comprising at least one top restraint, wherein the at least one top restraint is configured to couple to the top of said front gate and said brace.

10. The apparatus of claim 1, wherein the front wedge comprises two or more arms; and wherein the two or more arms are arranged such that a first arm closest to the base portion is shorter than a second arm farther from the base portion.

11. The apparatus of claim 1, wherein the sheet engaging member is slidable relative to the at least one arm.

12. The apparatus of claim 1, wherein the front wedge further includes notches at the end of sheet engaging member.

13. A method for transporting at least one sheet-like article, comprising:

loading said at least one sheet-like article on to a base portion;

coupling a front gate to said base portion;

coupling at least one top restraint to said base portion and said front gate;

providing a sheet engaging member coupled to said front gate via at least one arm; and providing a transportation mechanism configured to transport said base portion;

wherein the at least one arm comprises a bar and a bracket;

wherein the bar has a first end and a second end;

wherein the first end of the bar is coupled to the bracket and the second end of the bar is slidably connected to the sheet engaging member;

wherein said sheet engaging member is configured to engage said at least one sheet-like article by moving relative to said at least one arm until the sheet engaging member is in contact with the at least one sheet-like article; and wherein said transportation mechanism transports said base portion with said at least one sheet-like article after the front gate and at least one top restraint have been coupled.

14. An apparatus for transporting at least one sheet-like article, comprising:

a base portion;

at least one back post extending upwardly from the base portion and oriented to support said at least one sheet-like article;

at least one brace extending vertically from said base portion;

wherein said at least one brace is oriented to support said at least one back post;

at least one cleat extending from said base portion at an angle from horizontal and configured to support said at least one sheet-like article;

wherein the at least one cleat is coupled to the apparatus;

a front gate movable between a transportation position and a loading position;

wherein said transportation position comprises said front gate being coupled to said base portion;

wherein said loading position comprises said front gate being removed from said base portion;

at least one front wedge coupled to said front gate;

wherein each front wedge includes at least one arm and a sheet engaging member;

wherein the at least one arm comprises a bar and a bracket;

wherein the bar has a first end and a second end;

wherein the first end of the bar is coupled to the bracket and the second end of the bar is slidably connected to the sheet engaging member;

wherein said sheet engaging member is configured to engage said at least one sheet-like article by moving relative to said at least one arm of the front wedge until the sheet engaging member is in contact with the at least one sheet-like article; and wherein said sheet engaging member is a bar with a flat face configured to engage the at least one sheet-like article.

15. The apparatus of claim 14, wherein a right angle is formed between said at least one cleat and said at least one back post.

16. The apparatus of claim 14, wherein said at least one cleat extends from said base portion at a five degree angle from horizontal and said at least one back post extends from said base portion at a ninety-five degree angle from horizontal.

17. The apparatus of claim 14, wherein the sheet engaging member is slidable relative to the at least one arm.

* * * * *